United States Patent [19]

Namiki

[11] 3,948,215

[45] Apr. 6, 1976

[54] FIXING TONER IMAGES IN ELECTROPHOTOGRAPHY

[75] Inventor: Ryoichi Namiki, Hino, Japan

[73] Assignee: Ricoh Co., Ltd., Tokyo, Japan

[22] Filed: Dec. 20, 1974

[21] Appl. No.: 534,884

Related U.S. Application Data

[62] Division of Ser. No. 336,460, Feb. 28, 1973, abandoned.

[30] Foreign Application Priority Data

Mar. 14, 1972 Japan ..... 47-25896

[52] U.S. Cl. ..... 118/60; 432/60; 427/22

[51] Int. Cl.[2] ..... G03G 15/20

[58] Field of Search ..... 118/60, 59; 432/59, 60, 432/228; 117/21; 427/22; 219/216

[56] References Cited

UNITED STATES PATENTS

| | | | |
|---|---|---|---|
| 3,637,976 | 1/1972 | Ohta et al. | 118/60 |
| 3,666,247 | 5/1972 | Banks | 118/60 |
| 3,667,742 | 6/1972 | Kamola | 118/60 |
| 3,716,018 | 2/1973 | Ohta et al. | 118/60 |
| 3,811,821 | 5/1974 | Ariyama et al. | 432/60 |
| 3,811,828 | 5/1974 | Ohta et al. | 432/59 |

*Primary Examiner*—Mervin Stein
*Assistant Examiner*—Douglas Salser
*Attorney, Agent, or Firm*—Cooper, Dunham, Clark, Griffin & Moran

[57] ABSTRACT

A toner image formed on a support sheet by toner particles adhering to selected areas of the sheet is fused either by simply disposing the sheet in with a heating surface, or by additionally pressing the sheet. After the toner image particles are fused, the sheet is cooled while maintaining its image bearing side in contact with the surface previously used for heating, so that the toner particles solidify and the toner image is stiffened. The sheet is then separated from the surface with which it was previously in contact. In the course of heating, some toner particles of the image may temporarily adhere to the heating surface, but in the course of the cooling step, these toner particles develop a stronger adhesion to the remainder of the image and to the sheet. Thus, after the cooling step, no toner particles remain on the surface contacted by the sheet, and the so-called "offset phenomenon" does not occur.

4 Claims, 8 Drawing Figures

FIXING TONER IMAGES IN ELECTROPHOTOGRAPHY

This is a division of application Ser. No. 336,460, filed Feb. 28, 1973, now abandoned.

BACKGROUND OF THE INVENTION

The invention relates to fixing toner images in electrophotograpy, and is specifically concerned with methods and devices relating to fixing an image formed by toner particles by heating and drying the image.

In dry type electrophotographic processes, a toner image which is on a paper sheet or on another supporter is fixed by heating the sheet. For example, the sheet may be heated by being brought in direct contact with a heated surface, such as, for example, the peripheral surface of a heating drum. One disadvantage of contact heating is that the toner particles forming the image are rendered tacky by heating, and portions of the toner image may adhere to the periphery of the heating drum. As a result, when the next sheet bearing a toner image is brought into contact with the heating drum, the tacky toner particles removed from the preceding sheet may be transferred to that next sheet. At the same time, portions of the toner image supported on that next sheet may adhere to the periphery of the heating roller, and the cycle may be repeated. The phenonmenon of portions of the toner image of one sheet adhering to the heating drum and being transferred to the next sheet is generally referred to as the "ofset phenomenon", and it is detrimental to the quality of the fixed image.

In an effort to preclude or reduce this offset phenomenon, heating drums have been covered with layers of a highly non-tacky material, such as silicon rubber or Teflon. Different results are achieved with different materials. Generally, materials having a higher percentage of organic components are preferred. Materials suitable for this purpose are rubber compounds made of raw silicon rubber containing dimethylpolysiloxane as a principal raw material and vulcanized at normal or low temperature. However, raw silicon rubber is expensive, and the cost of producing a cover layer of this type is further increased because various fillers, extending agents, and vulcanizing agents are also added to the raw material.

Even if such expensive cover layers for heater drums are used, it may be impossible to completely preclude the offset phenomenon. In fact, it has not been ascertained yet what is the optimal type of a heating drum surface which would completely preclude the offset phenomenon. All that has been known up to now is that the surface condition of the heating drum has an important bearing on the adhesion of toner particles to the next sheet bearing a toner image; it has not been known how best to prevent this offset phenomenon.

The fact is that the offset phenomenon has remained a problem in fixing toner images, and it is therefore desirable to find ways to completely or substantially preclude the offset phenomenon.

SUMMARY OF THE INVENTION

The invention is directed to methods and devices for preventing the offset phenomenon in fixing toner images formed by toner particles adhering to selected areas on support sheets. The invention relies on the discovery that the toner particles images which are fused by heating tend to stiffen when the toner particles images solidify upon cooling. Based on this discovery, the toner particles forming an image are first thoroughly heated and fused, and are then suddenly cooled while maintaining the image in contact with the heating means, such that the image is given a chance to solidify and stiffen before it is removed from contact with the heating means. Although toner particles may adhere to the heating means during heating, and in the initial portions of the cooling cycle, the adhesion of the particles to the remainder of the image and to the support sheet is stronger at the end of the cooling cycle, and the sheet, with the entire image thereon, may be separated from the heating means at the end of the cooling cycle.

Specifically, in the heating step, heat is transmitted from a heating means to the toner image formed on a support sheet. The toner particles are heated substantially to their fusing point temperature to bring them to a substantially fluid state. By heating the particles for a period from 1 to 10 seconds so as to bring them to a viscosity of $10^{11}$ to $10^{12}$ B, the toner image is brought substantially to the fusing point temperature. The heating step can be carried on by holding a toner image bearing support sheet between two heating plates and appplying pressure to the heating plates, or by passing a toner image bearing support sheet between two heating rollers which are in pressing engagement with each other, or by a combination of heating plates and heating rollers.

In the cooling step, the fused toner particles are cooled so that their hardness increases to a point prevailing at the glass transition point temperature or at a temperature below that. Generally, the cooling step takes about as much time as the heating step. The cooling step can be carried out by cooling at room temperature, or by means of forced cooling through a stream of air or a stream of water. It is important to note that the toner image remains in contact with the heating means in the course of the cooling step, so that the toner image is allowed to stiffen and solidify before the sheet is separated from the heating means.

Finally, after the toner image has stiffened and solidified in the cooling step, the sheet, with the toner image thereon, is separated from the heating means. The removing step can be carried on by using pick-off claws or by utilizing a stream of air.

Although heating plates and means for heating the plates and for introducing a sheet between them and for removing the sheet may be utilized in carrying out the subject invention, a preferred embodiment comprises an endless belt trained over a first heating roller and over a guide roller, and a second heating roller pressing against the first heating roller across a portion of the lower run of the endless belt. At least one of these heating rollers is heated. The rollers are rotated such that the lower run of the endless belt moves away from the heating rollers. A toner image bearing sheet is introduced between the two heated rollers such that the toner image thereon faces the lower run of the endless belt and contacts it. The sheet is moved away from the heating rollers along the lower run of the endless belt. The portion of the sheet which is between the two heating rollers is heated thereby such that the toner particles forming the image are fused. As the fused toner image moves away from the heating rollers along the lower run of the endless belt, the cooling cycle begins, but the sheet and the toner image thereon remains in contact with the lower run of the endless belt. When the cooling cycle is ended, the image has stiffened and solidified, and the sheet is peeled off from the lower run of the endless belt.

Different embodiments of a toner device utilizing the principles discussed above are disclosed.

DETAILED DESCRIPTION

Figure 1:
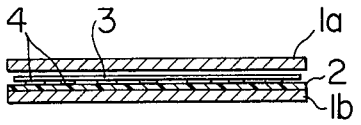
FIG. 1 is a schematic sectional view utilized in describing the fundamental principles of the invention.

Referring to FIG. 1, a support sheet 3 has a toner image 4 on its downwardly facing surface, and is disposed intermediate heater plates 1*a* and 1*b*. The heater plates 1*a* and 1*b* may be glass plates or metallic plates, and the lower heater 1*b* has an upper surface which is coated with a layer 2 of a non-tacky material, such as Teflon, silicon rubber or the like.

The heater plates 1*a* and 1*b* heat the sheet 3 and the toner image 4 thereon until the toner particles forming the toner image 4 are fused. Since the toner image 4 are heated from both sides, a point is reached at which a portion of the toner particles near the heater 1*b* and a portion of the toner particles near the support sheet 3 are fused, while the intermediate portion of the toner particles forming the image 4 remain in powder form. Therefore, if heating is stopped at this point and the support sheet 3 is pulled away from the heater 1*b*, the toner image may be broken such that a portion of it may remain on the layer 2 covering the heating plate 1*b*, thus initiating the offset phenomenon.

This problem becomes particularly severe in automated electrophotographic devices in which fixing of the toner images is carried out at high speeds. Additionally if the heating of the sheet side which does not bear a toner image is delayed as compared with heating the toner image bearing side of the sheet, or is less than the heating of the toner image bearing side, the entire toner image may be peeled off the support sheet 3 as the sheet is separated from the heater 1*b*. In order to prevent such undesirable effects, it is necessary to thoroughly heat the toner image 4.

When thoroughly heated, the toner particles forming the image 4 pass through the glass transition point and through the rubbery region (viscous region), and enter the fluid region. The opportune time to stop heating is when the toner particles are in the viscous region or in the initial stages of the fluid region.

When heating is stopped and cooling is initiated, the fused toner particles tend to solidify, thus causing the toner image 4 to adhere to the support sheet 4 rather than to the layer 2 on the lower heater plate 1*b*. After cooling, the toner image 4 adheres to the support sheet 3 with a greater force than to the layer 2 on the lower heater plate 1*b* if a major portion of the toner particles forming the image 4 has a hardness which can be obtained at or near the glass transition point temperature.

As a final step, the fixing of the toner image is completed by removing the heater plates 1*a* and 1*b* from the support sheet 3. The aforementioned process produces toner images which are fixed firmly on the support sheet 3 and are glossy in appearance.

Figure 2A:
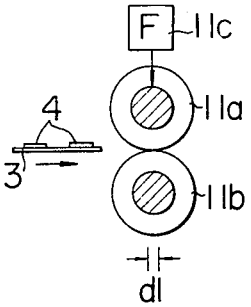
FIGS. 2A, 2B and 2C are schematic views illustrating the fundamental principles of the invention when heating rollers are utilized.

The support sheet 3 may be heated by heating drums or rollers rather than by heating plates of the the type discussed above. The principles of the subject invention, as applied to using heating rollers, are discussed in general terms in connection with FIGS. 2A, 2B and 2C. Referring to FIG. 2A, the heating step is carried out by means of an upper heating roller 11a and a lower heating roller 11*b* which are pressed against each other by a pressing means 11*c*. The circumference of the upper roller 11a is heated to a temperature in the range of 150° C. to 200° C., while the circumference of the lower roller 11*b* is heated to about 30° C. The pressure applied by the means 11*c* is such that the rollers 11*a* and 11*b* press against each other with a pressure ranging from 100 to 1,000 g/cm². Because of the pressure, the circumferences of the rollers 11*a* and 11*b* are in contact with each other for a distance of about 3 to 5 millimeters measured in a direction transverse to their axis. When a support sheet 3 bearing a toner image 4 on its upper surface is introduced between the rollers 11*a* and 11*b* of FIG. 2A in the indicated direction, and the rollers 11*a* and 11*b* are suitably rotated, the sheet 3 and the toner image 4 thereon are subjected to both heat and pressure. However, the heat and pressure are not sufficient to fix the toner image thereon.

Figure 2B:
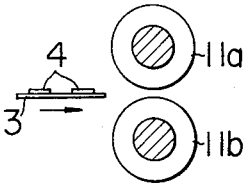

Referring to FIG. 2B, the arrangement of heater rollers 11*a* and 11*b* is the same as in FIG. 2A, except that the temperature of the lower heater roller 11*b* is in the range of 120° C. to 150° C., and no pressure is applied to press the rollers 11*a* and 11*b* against each other. The temperature of the rollers is again not sufficient to fix the toner image 4 on a sheet 3 past between the rollers 11*a* and 11*b* of FIG. 2B in the indicated direction.

Figure 2C:
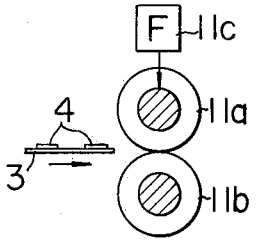

Referring to FIG. 2C, the arrangement of the heater rollers 11*a* and 11*b* is the same as in FIG. 2A, and the temperatures of the rollers 11*a* and 11*b* are the same as in FIG. 2B. The rollers 11*a* and 11*b* of FIG. 2C are pressed against each other as the rollers 11*a* and 11*b* of FIG. 2A. When a sheet 3, bearing a toner image 4, is passed between the rollers 11*a* and 11*b* of FIG. 2C in the indicated direction, the combination of heat and pressure is sufficient to fix the toner image 4.

The secondary transition point of the toner particles is in a range from 40° C. to 80° C. and the fusing point is at a temperature which is about 1.5 to 2 times the secondary transition point temperature.

Figure 3:
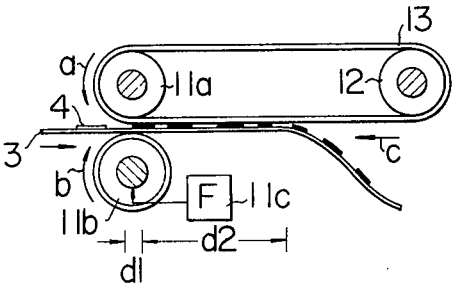
FIG. 3 is a schematic sectional view of a toner image fixing device.

An embodiment for carrying out the invented method is illustrated in FIG. 3 and comprises an endless belt 13 trained over an upper heating roller 11*a* and a guide roller 12, and moved in the direction of an arrow *a*. The circumference of the upper heating roller 11*a* is heated to a temperature of about 150° C. by a suitable heater (not shown in FIG. 3). A lower heating roller 11*b* is disposed below the upper heating roller 11*a* and is pressed against it by a suitable pressing means 11*c*, such that the rollers 11*a* and 11*b* press against each other at a pressure of about 400 g/cm². The arrangement of the rollers 11*a* and 11*b* and of the belt 13 is such that the circumference of the lower roller 11*b* is maintained in contact with the belt 13 for a distance of about 5 mm. The lower heating roller 11*b* is heated by a suitable heating means (not shown in FIG. 3) such that the temperature at its circumference is about 130° C. The rollers 11*a* and 11*b* are rotatably mounted and are rotated by suitable means (not shown in FIG. 3) to rotate the directions of the arrows *a* and *b* respectively. A support sheet 3, bearing on its upper surface a toner image 4, is introduced between the rollers 11*a* and 11*b* and is moved thereby in the direction shown in FIG. 3. When the sheet 3 is first introduced between the rollers 11*a* and 11*b*, the image bearing side thereof contacts the portion of the lower run of the endless belt 13 which is directly below the upper roller 11*a* and is heated thereby. The length of the support sheet 3 which is in direct contact with both the lower run of the endless belt 13 and the circumference of the lower roller 11*b* is marked $d_1$ at FIG. 3. After passing between the rollers 11*a* and 11*b*, the support sheet 4 continues rightwardly in FIG. 3 for a distance $d_2$ while its upper side remains in direct contact with the lower run of the endless belt 13. The region $d_1$ is for heating, while the region $d_2$ is for cooling. After the region $d_2$, the support sheet 3 and the toner image 4 thereon are separated from the lower run of the endless belt 13 by means of claws (not shown in FIG. 3) or by means of an air stream acting in the direction of the arrow *c*.

When toner particles are heated in the absence of pressure, heating for a period of time from 1 to 10 seconds may be required to cause the toner particles to attain a viscosity of $10^{11}$ to $10^{12}$P. In the device illustrated in FIG. 3, the sum of the temperatures of the upper and lower heating rllers 11*a* and 11*b* is about 300° C., while the melting point of the toner particles is about 150° C. Thus, in the absence of pressure between the rollers 11*a* and 11*b*, if the heating time is 0.05 seconds, there would be a deficiency of 1/10 to 1/100 in the amount of heat. The deficiency in the amounted heat is compensated for by the pressure between the rollers 11*a* and 11*b*.

Figure 4:
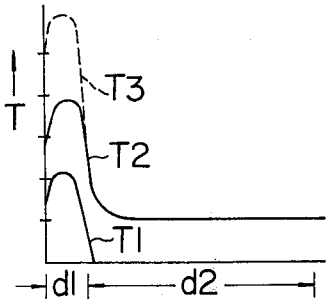
FIG. 4 is a graph showing the heating and cooling cycles utilized in the invention.

Referring to FIG. 4, where the vertical axis is heat and the horizontal axis is distance along the path of the support sheet 3, a curve T1 shows the amount of heat given to the toner image 4 by the lower heating roller 11*b*, a curve T2 shows the amount of heat given to the toner image 4 by the run of the endless belt 13 which is in contact with the toner image over the distance $d_1$, and a curve T3 shows the total amount of heat given to the toner image 4, which includes the heat from the upper roller 11*a* and the heat due to the pressure between the rollers 11*a* and 11*b*. The toner image 4 is rapidly cooled when delivered to the region $d_2$ where no pressure is applied to the toner image.

It is noted that the influence of pressure is great when transmission of heat takes place in a powdery substance. Thus, the toner image can be heated rapidly when pressed between the rollers 11*a* and 11*b*, and can be cooled rapidly when the pressure is absent over the region $d_2$. Cooling time may be shortened by exposing the toner image to stream of air, or the like, while in the region $d_2$.

When the toner image 4 consists of characters having small black areas, i.e., when the areas of the sheet 3 covered by the toner is relatively small, the amount of heat stored in the toner image 4 is low and the image is cooled quickly. Thus, the support sheet 3, with the fixed toner image 4 thereon, can be safely peeled off from the lower run of the endless belt 13 early in the region *d*. But when the toner image 4 covers a substantial portion of the support sheet 3, a greater amount of heat is stored in the toner image and the supporter sheet 3 remains adhering to the endless belt 13 for a greater portion of the cooling region $d_2$, or the cooling region $d_2$ may have to be extended to the rightward end of the lower run of the endless belt 13. Claws, or a stream of air acting in the direction of the arrow *c* in FIG. 3 may be provided to ensure that the support sheet 3 is peeled off the endless belt 13 at the end of the cooling region.

Figure 5:
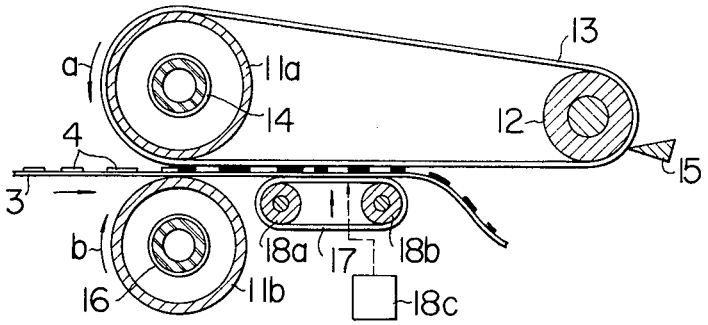
FIG. 5 is a schematic sectional view showing a modified toner image fixing device.

A modified device is shown in FIG. 5 and comprises an upper heating roller 11*a* which has a built-in heater 14. The relative dimensions of the elements of FIG. 5 may be such that the diameter of the upper heating roller 11*a* may be 50 mm while the diameter of the guide roller 12 may be 10 to 20 mm. A conveyor belt 13 is trained over the rollers 11*a* and 12 and pick-off claws 15 are disposed opposite the outer periphery of the roller 12, with the pointed ends of the claws 15 maintained in contact with the surface of the belt 13. The lower heating roller 11*b* also has a built-in heater 16 and has a smaller diameter than the upper heating roller 11*a*. The small diameter of the lower heating roller 11*b*, and hence its greater curvature, facilitates later removal of the toner image. A cooling conveyor belt 17 is disposed rightwardly of the lower heating roller 11*b*, beneath the lower run of the belt 13, to prevent the toner image and the support sheet 3 from separating from the belt 13 and moving downwardly before being thoroughly cooled. The belt 17 comprises a plurality of belt elements having a plurality of openings which are about 1 mm in diameter each. The belt 17 is trained over suitable rotatably mounted rollers 18*a* and 18*b*. A stream of air is supplied to the openings in the belt 13 by a suitable supply means 18*c*. Cooled guide plates may be used in place of the belt 17.

Figure 6:
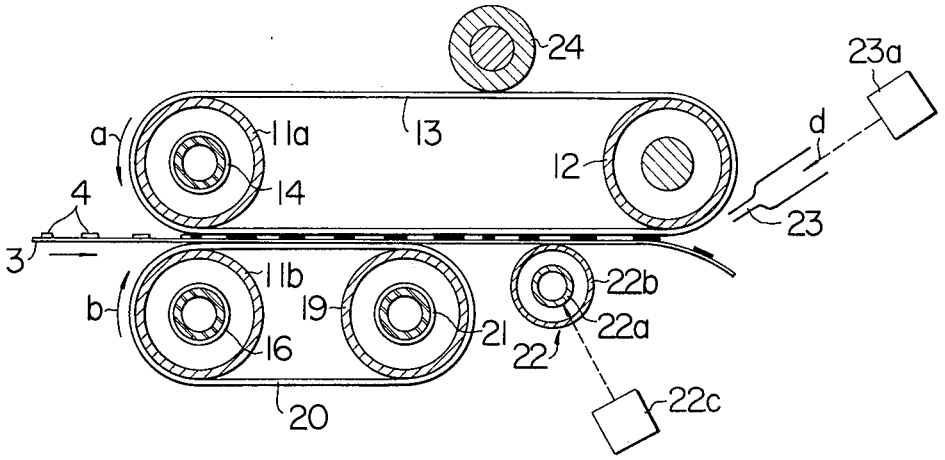
FIG. 6 is a sectional view of another modified device for fixing a toner image.

Another modification of a fixing device is shown in FIG. 6 and comprises a pair of endless belts arranged one above the other to define a passageway for the support sheet 3. An upper endless belt 13 is trained over an upper heating roller 11a having a built-in heater 14, and over a guide roller 12. Another endless belt 20 is trained over a lower heating roller 11*b* having a builtin heater 16 and disposed beneath the upper heating roller 11, and over another lower heating roller 19 disposed rightwardly of heating roller 11*b* and beneath the lower run of the endless belt 13. The heating roller 19 has a built-in heater 21. A cooling roller 22 is disposed rightwardly of the heating roller 19, and comprises a tubular shaft 22*a* which is coaxial with the roller 22, and an outer cylindrical element 22*b* which is coaxial with the tubular shaft 22*a*. A stream of air or water is supplied to the tubular shaft 22*a* by means of a suitable supply 22*c* to cool the circumference of the cylindrical element 22*b*. A nozzle 23 is provided for separating the toner image on the support sheet 3 from the belt 13, and a stream of air is supplied to the nozzle 23 by means of a suitable supply 23*a*, in the direction of the arrow *d*. A cleaning roller 24 is disposed on the upper run of the belt 13, and the circumference of the cleaning roller 24 is maintained in contact with the outer surface of the upper run of the belt 13 to clean that upper run of the belt 13. Preferably, the outer periphery of the cleaning roller 24 is made of material such as aluminum, iron or the like which tend to attract toner particles. The belt 13 may be made of a material such as Teflon or the like. The toner image 4 on the support sheet 3 is in a heating step when between the upper run of the belt 20 and the lower run of the belt 13. The support sheet 3 and the toner image 4 thereon are in a cooling step when rightwardly of the upper run of the belt 20.

I claim:

1. A device for fixing an electrophotographic image formed by toner particles adhering to selected areas on one side of a support sheet, comprising:

a first heater roller, a guide roller and an endless belt trained over said rollers and having a first run extending and moving away from the first heater roller;

a second heater roller disposed in pressing engagement with the first heater roller across a portion of said first run of the endless belt; and means for heating the heater rollers to maintain the heater rollers and the portion of the endless belt between them at a higher temperature than the remainder of said first run of the endless belt;

including cooling means disposed at the same side of said first run of the endless belt as the second heater roller and adjacent said second heater roller for cooling a portion of said first run of the endless belt which is moving away from the heater rollers and a support sheet or a portion thereof contacting said portion of the first run of the endless belt; and whereby said sheet, introduced between the heater rollers, with the toner image bearing side facing and contacting the first heater roller, moves between the heater rollers and then away from the heater rollers along said first run of the endless belt, while the toner image is subjected to heat and pressure when between the two heater rollers, but is subjected to cooling when moved away from the heater rollers by said moving first run of the endless belt.

2. A device as in claim 1 wherein said cooling means comprises a conveyor belt having a run abutting the first run of the endless belt, said run of the conveyor belt having a plurality of perforations therethrough, and means for applying to said run of the conveyor belt a stream of a cooling fluid.

3. A device as in claim 1 including means for separating said first run of the endless belt and a support sheet contacting said first run of the endless belt, said separating means disposed at a portion of the endless belt which is further from the heater rollers than the cooling means.

4. A device for fixing an electrophotographic image formed by toner particles adhering to selected areas on one side of a support sheet, comprising:

first heating means comprising a first heater roller, a guide roller, and a first endless belt trained over said rollers and having a first run extending therebetween;

a second and a third heater roller and a second endless belt trained over said second and third heating rollers, said second endless belt having a second run which is adjacent and parallel to a portion of said first run of the first endless belt;

means for supporting the rollers, with the first and second heating roller being in pressing engagement with each other across selected portions of the first and second runs of the endless belts;

a cooling roller disposed at the same side of the first run of the first endless belt as the second endless belt, and located on the same side of the second heater roller as the third heater roller, but further away from the second heater roller than from the third heater roller; and means for heating the heater rollers and for cooling the cooler roller to maintain the portions of the first and second runs of the endless belts which are adjacent each other at a higher temperature than the portion of the first run of the first endless belt to which the cooling roller is adjacent;

whereby a sheet bearing a toner image on a side thereof may be introduced between the first and second runs of the endless belts, with the toner image thereon facing and contacting the first run, and can be moved by means of said first and second runs of the endless belts toward the cooling roller while remaining in contact with the first run of the first endless belt, and can be cooled by said cooler roller while remaining in contact with the first run of the first endless belt.

* * * * *